US006830523B1

(12) United States Patent
Kuhn

(10) Patent No.: US 6,830,523 B1
(45) Date of Patent: Dec. 14, 2004

(54) MECHANICAL BROADHEAD ARROWHEAD

(75) Inventor: Todd A. Kuhn, Mims, FL (US)

(73) Assignee: 2XJ Enterprises, Inc., North East, MD (US)

( * ) Notice: Subject to any disclaimer, the term of this patent is extended or adjusted under 35 U.S.C. 154(b) by 0 days.

(21) Appl. No.: 10/766,664

(22) Filed: Jan. 28, 2004

(51) Int. Cl.[7] ..... F42B 6/08
(52) U.S. Cl. ..... 473/583; 473/584
(58) Field of Search ..... 473/582, 583, 473/584

(56) References Cited

U.S. PATENT DOCUMENTS 5,066,021 A * 11/1991 DeLucia ..... 473/583
5,078,407 A * 1/1992 Carlston et al. ..... 473/583
5,820,498 A * 10/1998 Maleski ..... 473/584
5,857,930 A * 1/1999 Troncoso ..... 473/583
6,287,224 B1 * 9/2001 Liechty, II ..... 473/584
6,398,676 B1 * 6/2002 Mizek ..... 473/583
6,428,434 B1 * 8/2002 Liechty, II ..... 473/583
6,595,881 B1 * 7/2003 Grace et al. ..... 473/583

* cited by examiner

*Primary Examiner*—John A. Ricci

(57) ABSTRACT

The invention is a mechanical broadhead arrowhead. The broadhead arrowhead includes a ferrule. A fixed main blade assembly extend outwardly from the ferrule. This main blade assembly has a first substantially planar portion disposed in a plane at least substantially parallel to a longitudinal axis of the ferrule and a two continuously curved second portions offset at angle to the plane of the first planar portion such that the blade assembly has an airfoil-type shape. A number of deployable blades attached to the ferrule also have substantially planar portions and continuously curved portions. The main blade and deployable blades act together as an axial flow turbine during flight. The ferrule further comprises an inertial trigger mechanism that both inhibits premature deployment of the deployable blades during release and flight, yet also promotes deployment of deployable blades during impact with a target.

27 Claims, 8 Drawing Sheets

CLOSED POSITION

CLOSED POSITION
SECTION A-A

OPEN POSITION

OPEN POSITION
SECTION B-B

MECHANICAL BROADHEAD ARROWHEAD

BACKGROUND OF THE INVENTION

1. Field of the Invention

The present invention relates to the field of archery. Specifically, the invention relates broadhead arrowheads found on arrow devices.

2. Description of the Prior Art

Arrowheads have been used in bowhunting for thousands of years. Prior art broadhead arrows were invented to increase effective hunting penetration and success potential. Typically two to four flat, triangular blades are arranged around the forward pointed tip. As the tip enters the intended target, the blades slice a region much greater than the diameter of the arrow shaft. Unfortunately, these broad, flat blades have a pronounced aerodynamic effect that can radically affect the overall stability of the arrow in flight and significantly reduce the precision of flight.

Mechanical broadhead arrowheads were developed to address problems associated with traditional bladed broadheads. Mechanical broadheads include deployable bladed or spiny bleeder appendages that remain closely attached to the main body of the arrowhead from release until impact. This reduces the overall aerodynamic effect of large, bladed structures during flight. Upon deployment, such appendages provide greater cutting surfaces and or means for lodging within the wounded target than a simple flat blade.

One problem with prior art mechanical designs is the means for preventing premature deployment of the mechanical bleeder blades is often imprecise and unreliable. One such means commonly found in the art is an elastic band wrapped around both the shaft and deployable appendages. During penetration, the elastic band must be broken or forced rearward in order for deployment to occur. Because such a means directly contacts the wound, the amount of drag applied to the means can be affected by the consistency of the immediate wound site. Soft portions of the target provide insufficient drag to trigger deployment. For all these reasons, deployment of prior art mechanical broadheads often fails.

SUMMARY OF THE INVENTION

The present invention is a mechanical broadhead arrowhead with two key features. The first key feature is the geometry of the main blade, which includes a flat primary portion and two trailing portions that are each continuously curved out of the plane of the main blade in the same rotational direction. This airfoil design provides excellent rotation of the arrow shaft during flight without producing a large amount of aerodynamic drag.

A second key feature of the present invention is the inclusion of mechanically deployable blades. These deployable blades include a novel spring-loaded inertial trigger mechanism that both inhibits premature deployment during release and flight yet also facilitates deployment during impact with the intended target. The invention is compatible with all contemporary arrow shafts.

DETAILED DESCRIPTION OF THE INVENTION

Figure 1:
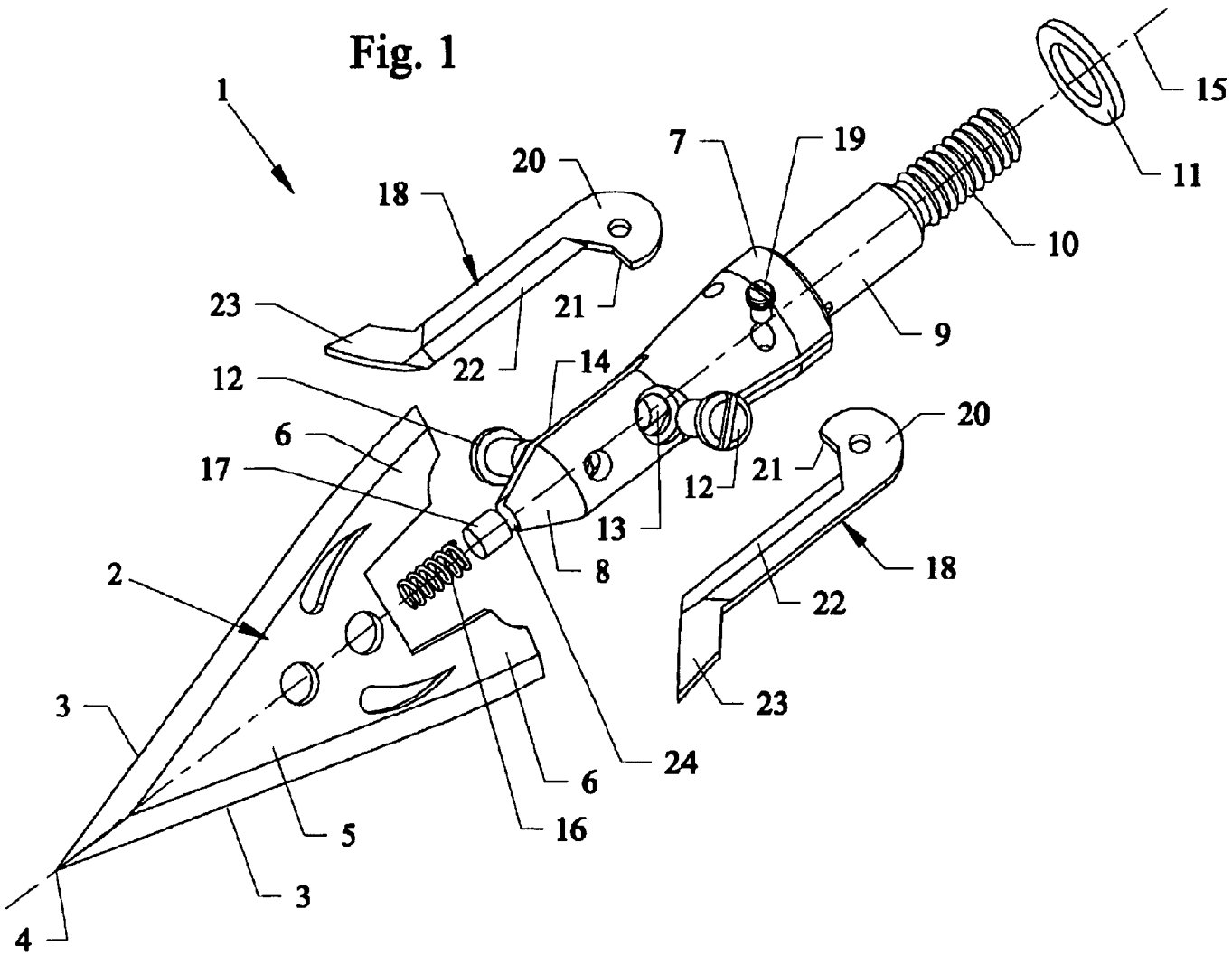
FIG. 1 shows an exploded view of the broadhead arrowhead of the present invention.
Figure 2:
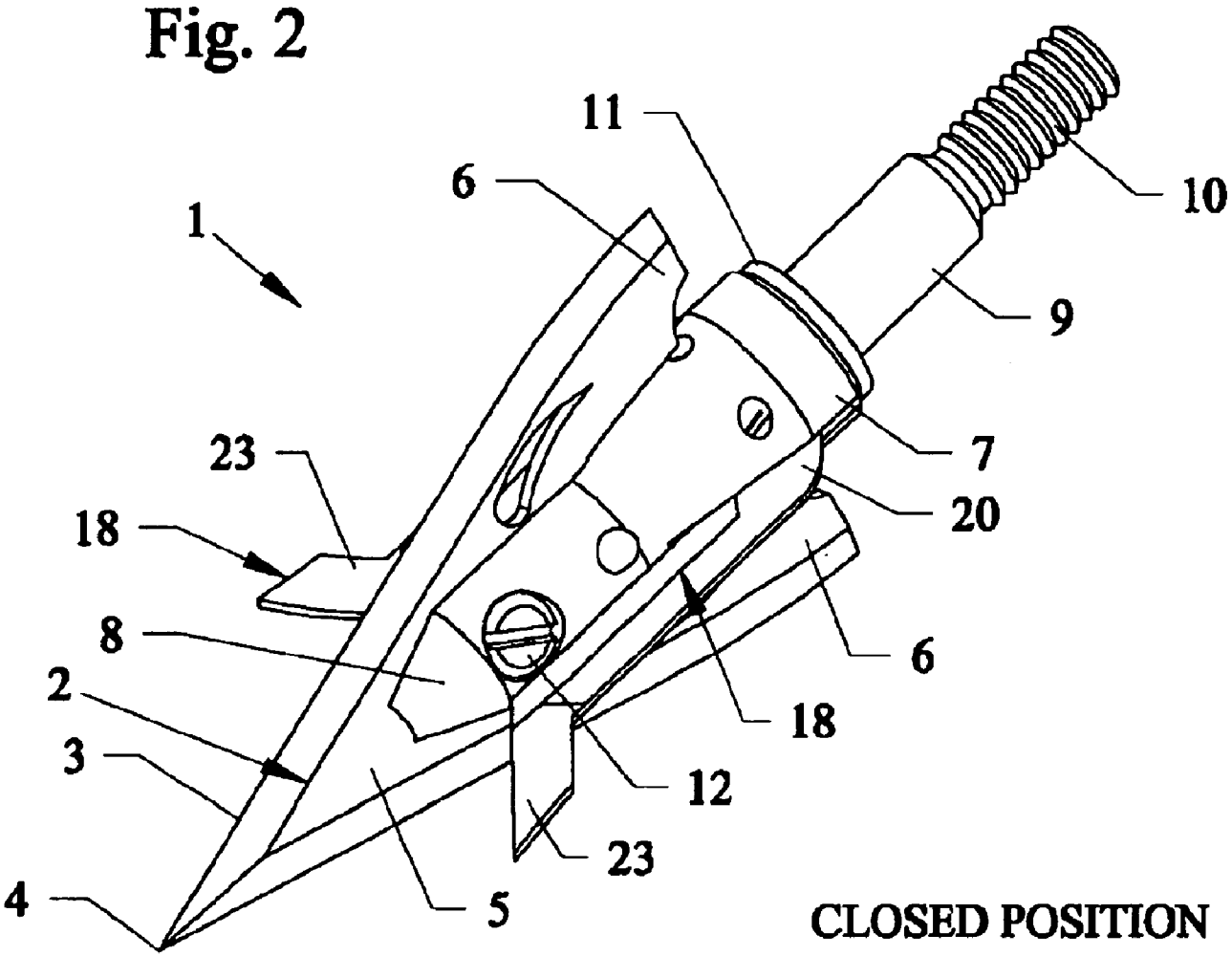
FIG. 2 shows an oblique view of the broadhead arrowhead in the closed position.

With reference to FIGS. 1 through 9, the broadhead arrowhead assembly 1 of this invention comprises a body or ferrule 7. At a first, or proximal, end, ferrule 7 incorporates a first end portion 8. First end portion 8 typically tapers to a reduced diameter at its most proximal end. Ferrule 7 also has a second, or distal, end portion 9. Second end portion 9 is of reduced diameter so that it may fit within the hollow end of a conventional arrow shaft. The aft portion of ferrule 7 may be slightly flared outwardly. It is not necessary that the aft portion of ferrule 7 be flared outwardly, however. In some embodiments, the aft portion of body 7 may continue substantially straight along its length until the reduced diameter of second end portion 9. Ferrule 7 is typically symmetrical about a longitudinal axis 15 between first end portion 8 and second end portion 9.

A mounting stub 10 extends rearwardly from second end portion 9 of arrowhead body 7. Typically, stub 10 is symmetrical about and coaxial with longitudinal axis 15. Mounting stub 10, along with second end 9, is intended to fit into a mating recess typically located at one end of a standard arrow shaft. Stub 10 may be threaded to mate with matching threads in the arrow shaft recess or it may be seated in the recess in a press fit arrangement. Alternatively, mounting stub 10 may be glued or otherwise sealed into the mating recess of the arrow shaft.

In other variations of mounting means, instead of a stub 10, second end 9 of body 7 may be of diameter equal to or greater than that of an arrow shaft. Second end 9 may then be hollowed out to fit over said arrow shaft. In such an arrangement, the inside of hollow second end 9 may be threaded to mate with threads on the outer surface of the arrow shaft; or distal second end 9 may be press fit over the arrow shaft. Alternatively, second end 9 may be fitted over the end of the arrow shaft and glued or otherwise sealed to the arrow shaft.

At least one main blade 2 extends laterally outwardly from ferrule 7 in two opposed directions. The preferred embodiment is constructed with only a single main blade, although embodiments with additional fixed blades are also anticipated by the invention.

Figure 8:
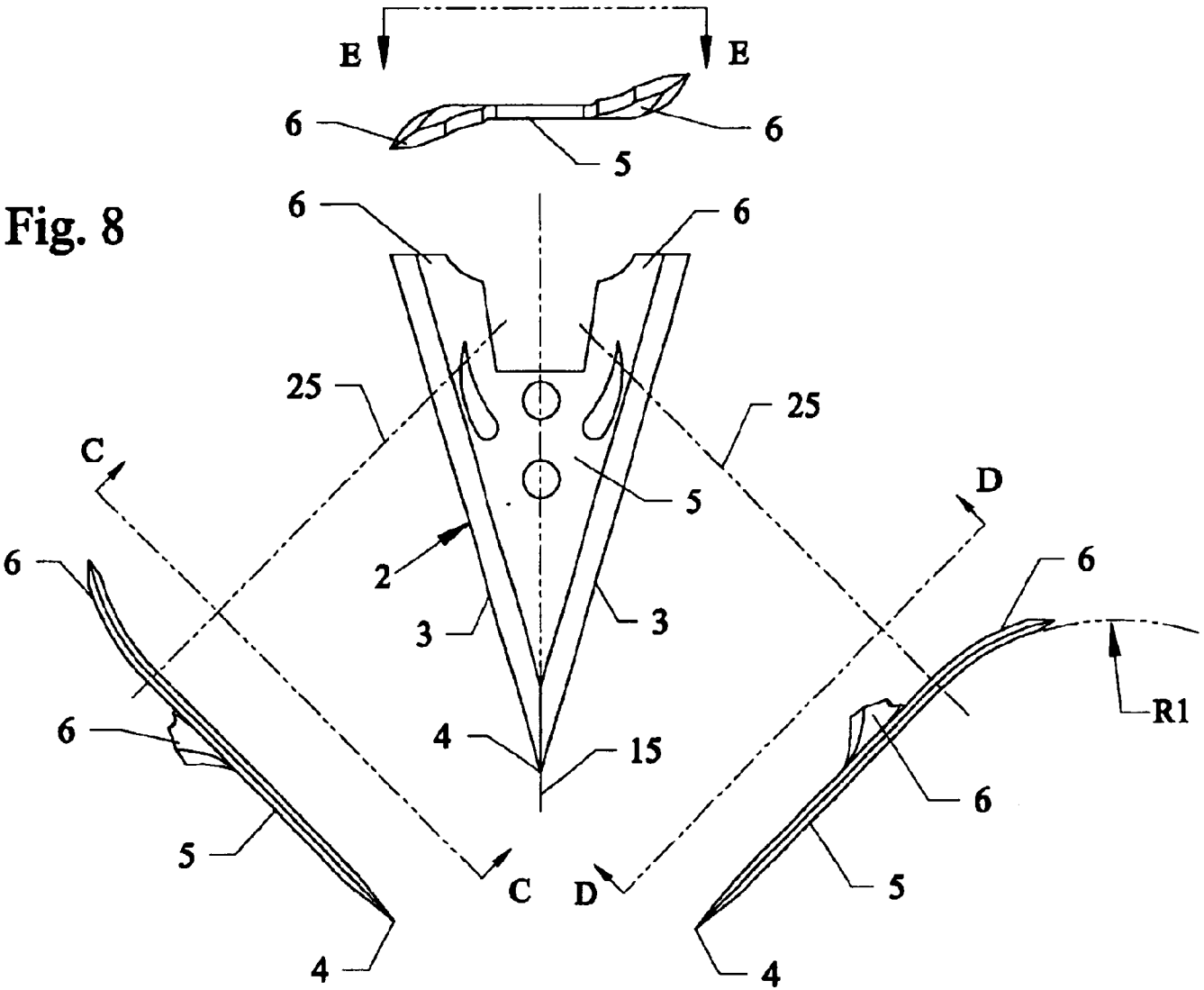
FIG. 8 shows details of the main blade geometry.

A key feature of the present invention is the geometry of main blade 2. The geometry of main blade 2 is shown in detail in FIG. 8. Main blade 2 extends laterally outwardly from body 7 in two directions diametrically opposite each other about longitudinal axis 15 of body 7 and disposed in a plane at least substantially parallel to the longitudinal axis 15 of body 7. Main blade 2 comprises a first substantially planar blade assembly portion 5 and two second blade assembly portions 6. Leading edges 3 of both first portion 5 and second portions 6 are typically sharpened and main blade 2 tapers to a point 4 at its leading edge to better allow the arrowhead to penetrate a target. First blade assembly portion 5 may comprise a solid substantially flat, continuous planar portion or optionally may have one or more cutout sections in the plane of the blade. Two second blade assembly portions 6 extend rearwardly from first blade assembly portion 5 each at an angle thereto. Second blade assembly portions 6 are preferably continuously curved, with a radius of curvature optimally between about 0.2" and 0.5", giving the blade the characteristics of an airfoil. The radius of curvature may vary over the surface of the blade. As shown by FIG. 8, in the preferred embodiment, second portion 6 curves out of the plane of first portion 5 at a constant radius of curvature R1 beginning at tangent line 25 and ending at the trailing edge of second portion 6. Tangent line 25 lies in the plane of first portion 5 at an angle in the range of approximately 5 and 45 degrees as measured from the tip 4 of main blade 2. The resultant trailing edge of second portion 6 is disposed at an angle to body 7 and also at an angle to first portion 5. This angle may be as great as 45 degrees or more, but optimally it is the range between approximately 5 and 35 degrees and most optimally in the range between approximately 5 and 25 degrees.

Figure 5:
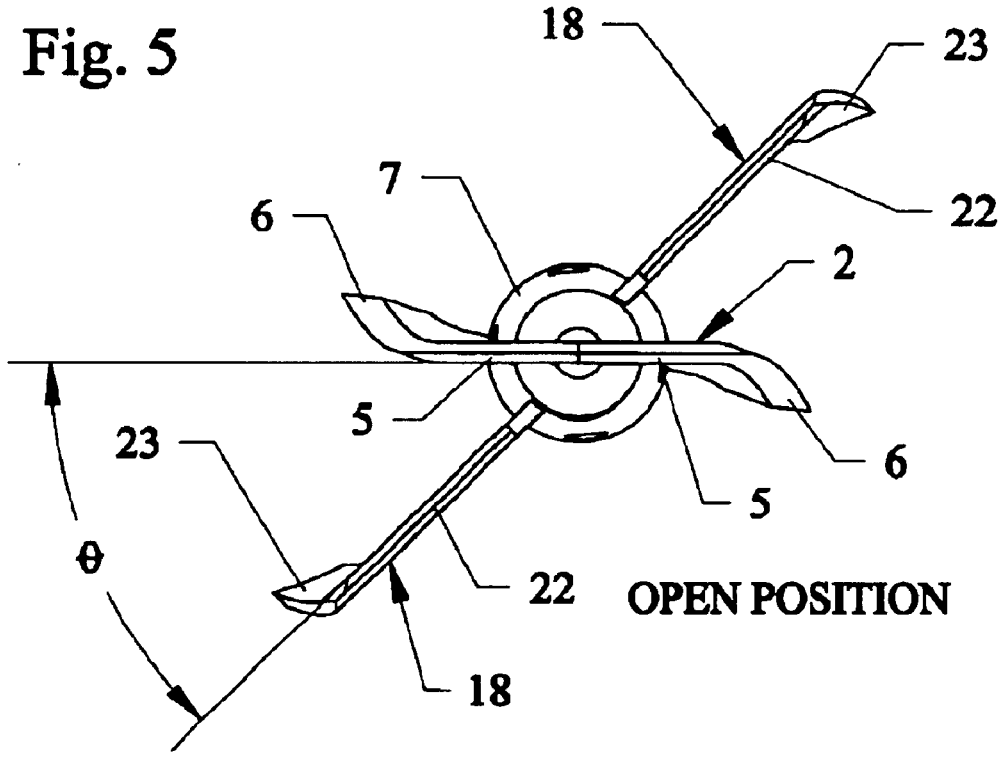
FIG. 5 shows a front view of the broadhead arrowhead in the open position.
Figure 4:
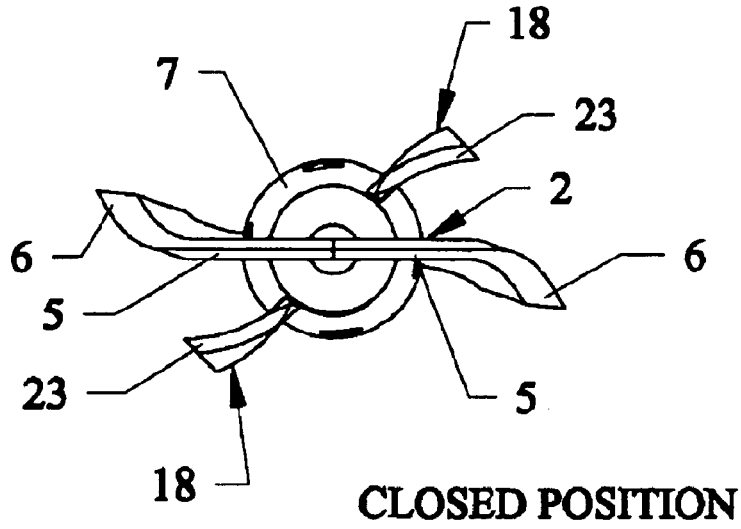
FIG. 4 shows a front view of the broadhead arrowhead in the closed position.
Figures 6A, 6B:
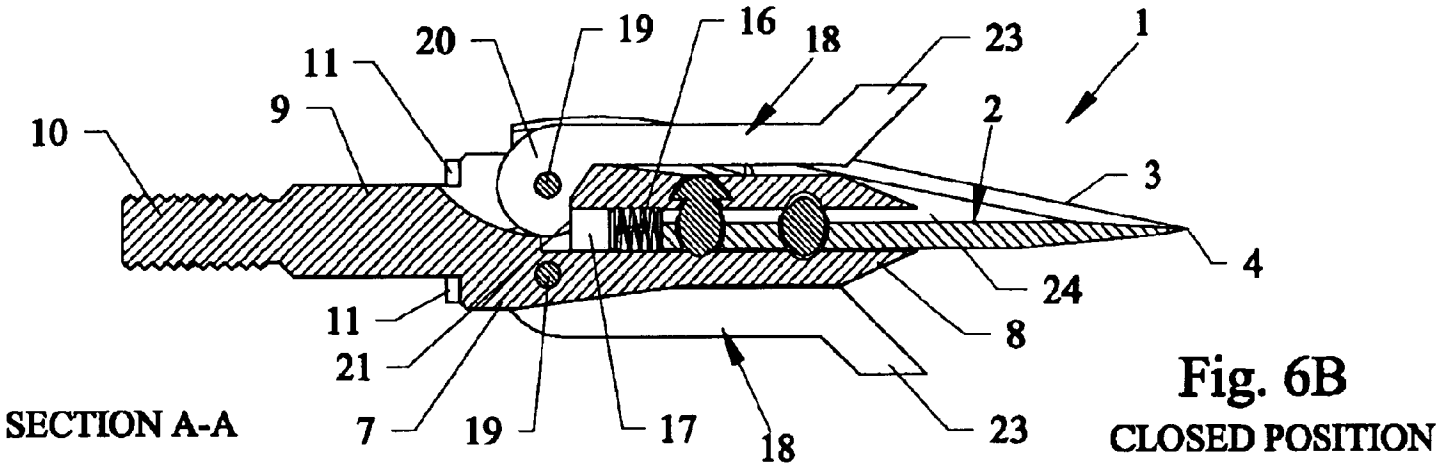
FIG. 6A shows a side view of the broadhead arrowhead in the closed position.
FIG. 6B shows a cutaway side view of the broadhead arrowhead in the closed position.

Second blade assembly portions 6 are angled out of the plane of first assembly portion 5 in opposing directions as shown in FIG. 4 and FIG. 5. The two second portions 6, acting together, form an axial-flow turbine. It will be understood by those skilled in the art that each second blade assembly portion 6 is preferably angled relative to first blade assembly portion 5 in the same rotational direction and at substantially the same angle to promote stable flight.

FIG. 4 and FIG. 5 show second portions 6 of main blade 2 angled clockwise relative to the major plane of first planar portion 5. Alternatively, second portions 6 can be angled counterclockwise relative to the major plane of first planar portion 5.

The length of first substantially planar portion 5 is between about 50% and 80% of the total length of blade assembly 2. Correspondingly, second portions 6 comprise between about 20% and 50% of the total length of main blade 2.

Alternatively, first planar portion 5 and second portion 6 may be joined at a more sharply defined angle with a radius of curvature close to or at "0". However, this alternative configuration does not produce the same high quality of aerodynamic effects as does the airfoil shape shown in the representative figures.

Arrowhead body 7 and main blade assembly 2 may be made of any suitable material, such as, but not limited to, steel, aluminum, plastic, etc. As shown in FIG. 1, first planar portion 5 fits into a main blade slotted opening 14 in body 7. First portion 5 may be glued, welded, soldered, or otherwise mechanically attached into main blade slot 14 of body 7. FIG. 1 shows a pair of screws 12 used to provide this attachment means. The use of screws permits easy blade replacement in the field. Alternatively, main blade 2 and body 7 may be integrally formed as by molding. Other techniques for securing main blade 2 to body 7 would be apparent to those skilled in the relevant arts.

Main blade slot 14 comprises a planar, longitudinal cut across the diameter of body 7 beginning at the proximal most face of first end 8 and continuing down the length of body 7 for approximately one half the total body length. Main blade slot 14 includes two transverse, threaded, main blade bores 13 machined into body 7 perpendicular to the plane of main blade slot 14. Each bore 13 can accept a main blade locking screw 12. In the preferred embodiment, bores 13 are on opposing circumferential surfaces of body 7 in order to provide an even weight distribution about longitudinal axis 15. Main blade bores 13 may be countersunk to provide a flush surface between the heads of screws 12 and the outer surface of body 7. When main blade 2 is installed, holes in the flat surfaces of main blade 2 line up with bores 13. Main blade locking screws 12 are threaded through bores 13 and main blade 2 in order to maintain an integral arrangement between main blade 2 and body 7.

In the embodiment shown, main blade 2 has the general shape of a substantially triangular or delta wing configuration. In other embodiments, main blade 2 can have the general shape of a swept wing or a straight wing.

Much like the control surfaces of an aircraft wing, the ratio of angled portion length to overall blade assembly length can be relatively small. For example, in one embodiment, the ratio of the length of angled second portion 6 to the overall length of main blade 2 is in the range of between 10% and 50%, and preferably between about 20% and 50%.

Second blade portions 6 produce a rotational torque about longitudinal axis 15. In flight, these forces induce a rapid rotation of the arrow about longitudinal axis 15 while minimizing aerodynamic drag. The plane of main blade 2 remains parallel to the shaft of the arrow along its cutting edges 3.

One of the features of the arrowhead of this invention is its ability to produce stabilized arrow flight without the use of fletching or tail fins (or feathers). The rotation induced in the arrow by the aerodynamically designed broadhead blades is sufficient to stabilize the arrow in flight. Eliminating or reducing the size of the fletching in fact improves flight characteristics because the rotational drag normally induced by the fletching is avoided. It should be noted, however, that all embodiments of the arrowhead of the invention can be used with fletched arrow shafts as well.

A second key feature of the present invention is the inclusion of mechanically deployable blades 18 including a novel inertial trigger mechanism that both inhibits premature deployment during release and flight yet also facilitates deployment during impact with the intended target. Deployable blade 18 comprises an elongated third blade portion 22 that is sharpened on the side adjacent to body 7 when in the closed position. Integral to a first end of third blade portion 22 is a semi-circular, cam-shaped fourth blade portion 20. Integral to a second end of third blade portion 22 is a flag-shaped fifth blade portion 23. Fifth blade portion 23 comprises between about 20% and 50% of the total length of deployable blade 18.

Figure 9:
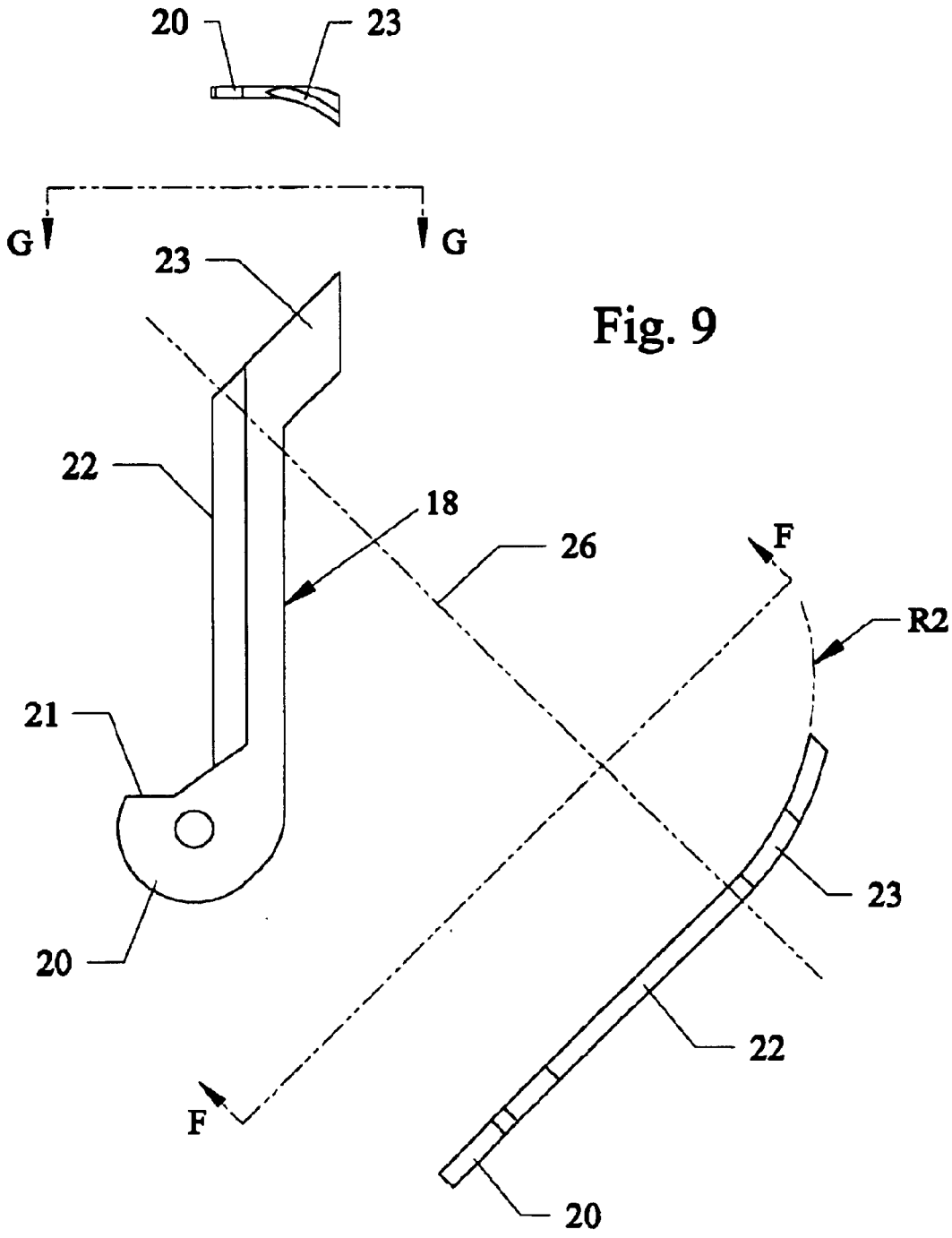
FIG. 9 shows details of the deployable blade geometry.

The geometry of deployable blade 18 is shown in detail in FIG. 9. Both elongated third blade portion 22 and integral cam-shaped fourth blade portion 20 are disposed in a plane at least substantially parallel to the longitudinal axis 15 of body 7. Flag-shaped fifth blade portion 23 extends from third blade portion 22 at an angle thereto. Fifth blade portion 23 is preferably continuously curved, with a radius of curvature optimally between about 0.2" and 0.5", giving the blade the characteristics of an airfoil. The radius of curvature may vary over the surface of the blade. As shown by FIG. 9, in the preferred embodiment, fifth blade portion 23 curves out of the plane of third blade portion 22 at a constant radius of curvature R2 beginning at tangent line 26 and ending at the leading edge of fifth blade portion 23. Tangent line 26 lies in the plane of third blade portion 22 at an angle in the range of approximately 5 and 45 degrees from the longitudinal axis 15 when deployable blade 18 is in the closed position. The resultant leading edge region of fifth blade portion 23 is disposed at an angle to body 7 and also at an angle to third blade portion 22. This angle may be as great as 45 degrees or more, but optimally it is the range between approximately 5 and 35 degrees and most optimally in the range between approximately 5 and 25 degrees. In the closed position, fifth blade portion 23 resembles a swept forward wing.

Broadhead assembly 1 includes at least one associated deployable blade 18 and preferably two deployable blades 18. Cam-shaped fourth blade portion 20 fits into a deployable blade slot 27, which is cut into the side of ferrule body 7. Deployable blade slot 27 is substantially coplanar with longitudinal axis 15 and is of a depth and geometry that permits deployable blade 18 to rotate freely about a pivot shaft 19 between the open position and the closed position as shown particularly in FIG. 6 and FIG. 7. In the preferred embodiment, pivot shaft 19 is a removable screw that permits easy replacement of deployable blade 18. Pivot shaft 19 is preferably perpendicular to the major plane of cam-shaped fourth blade portion 20. Deployable blades 18 and pivot screws 19 may be made of any suitable material, such as, but not limited to, steel, aluminum, plastic, etc.

As shown in the preferred embodiment in FIG. 4 and FIG. 5, deployable blade slots 27 and their associated deployable blades 18 are positioned at an angle θ from the major plane of main blade 2 when the broadhead assembly 1 is viewed from the front. Angle θ may be as great as 90 degrees, but optimally it is the range between approximately 20 and 70 degrees and most optimally in the range between approximately 40 and 50 degrees to permit easy access to pivot shafts 19 in order to replace deployable blades 18 as necessary. Deployable blade slots 27 are preferably disposed substantially symmetrically around the longitudinal axis of ferrule 7. In the preferred embodiment with a single main blade 2, two deployable blades 18 are disposed at an angle of approximately 180° from each other.

Each of the fifth blade assembly portions 23 are angled out of the plane of their respective third blade portion 22 in opposing directions as shown in FIG. 4 and FIG. 5. Fifth portions 23 of deployable blades 18, acting together with second blade portions 6 of main blade 2, form an axial-flow turbine. It will be understood by those skilled in the art that all second blade assembly portions 6 and fifth blade assembly portions 23 are preferably angled in the same rotational direction and at substantially the same angle to promote stable flight.

FIG. 4 and FIG. 5 show second portions 6 of main blade 2 and fifth portions 23 of deployable blades 18 angled clockwise relative to the major plane of first planar portion 5. Alternatively, second portions 6 and fifth portions 23 of deployable blades 18 can be angled counterclockwise relative to the major plane of first planar portion 5.

Ferrule 7 further comprises an inertial trigger mechanism that both inhibits premature deployment of deployable blades 18 during release and flight, yet also promotes deployment of deployable blades 18 during impact with a target. Cylindrical cavity 24 begins at the leading face of the first end 8 of body 7 and continues down the longitudinal axis 15 of body 7 to a depth approximately equal to the location of pivot shafts 19. The diameter of cylindrical cavity 24 is preferably in the range of 20% and 75% of the diameter of body 7 and most preferably in the range of 25% and 50% of the diameter of body 7. Cylindrical cavity 24 is symmetrical about longitudinal axis 15.

Trigger 17 comprises a solid cylinder of outer diameter slightly less than the inner diameter of cylindrical cavity 24 such that trigger 17 can slide freely within cylindrical cavity 24 without binding or becoming cocked. Trigger 17 includes a trailing surface that interfaces with ledges 21 on both cam-shaped fourth blade portions when deployable blades 18 are in the closed position. In the preferred embodiment, trigger 17 is a normal, right cylinder with walls perpendicular to its flat trailing surface. In this embodiment, both ledges 21 are also flat so that they contact trigger 17 along their entire length when deployable blades 18 are rotated into the closed position. Trigger 17 may be made of any suitable material, such as, but not limited to, steel, aluminum, plastic, etc. Trigger 17 may also be coated with a lubricant, such as graphite, silicone oil, mineral oil, polytetrafluoroethylene, etc., in order to inhibit friction or binding along the inner surface of cylindrical cavity 24.

A mechanical tensioner 16 is located between the leading face of trigger 17 and the trailing edge of main blade 2 within cylindrical cavity 24. When main blade 2 is integrated into broadhead assembly 1, the trailing edge of main blade 2 compresses tensioner 16, which in turn urges trigger 17 in the aft direction and down upon ledges 21 of deployable blades 18. Tensioner 16 may comprise a coiled spring, a plug of reversibly compressible material, such as solid silicone, a collapsible volume filled with a compressible fluid, or any other means for storing mechanical energy that would be apparent to one of ordinary skill in the art.

During release and flight, inertial forces act to relieve compression on tensioner 16, thereby further urging trigger 17 in the aft direction and firmly retaining deployable blades 18 in the closed position by pressing firmly upon ledges 21. In the closed position, third blade portions 22 of deployable blades 18 are in close contact with the sides of ferrule body 7. Flag-shaped fifth blade portions 23 are disposed at angles laterally outward away from the sides of body 7.

Figure 3:
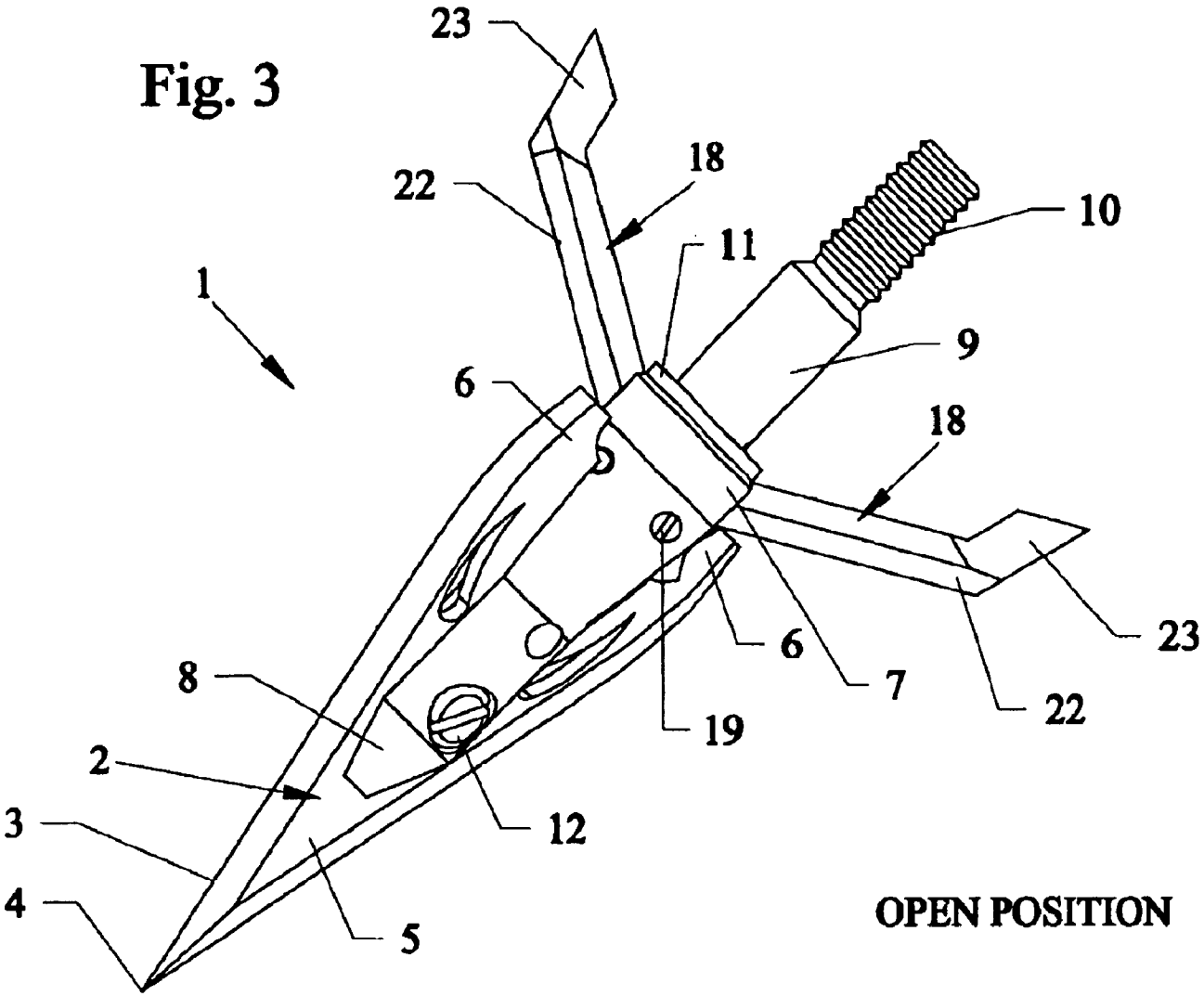
FIG. 3 shows an oblique view of the broadhead arrowhead in the open position.
Figure 7A:
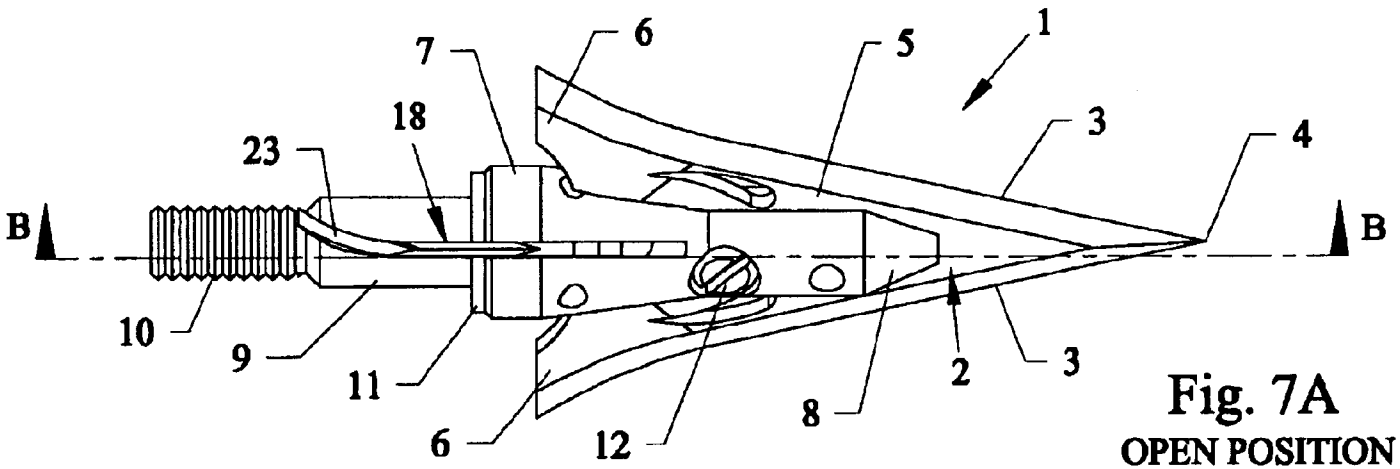
FIG. 7A shows a side view of the broadhead arrowhead in the open position.
Figure 7B:
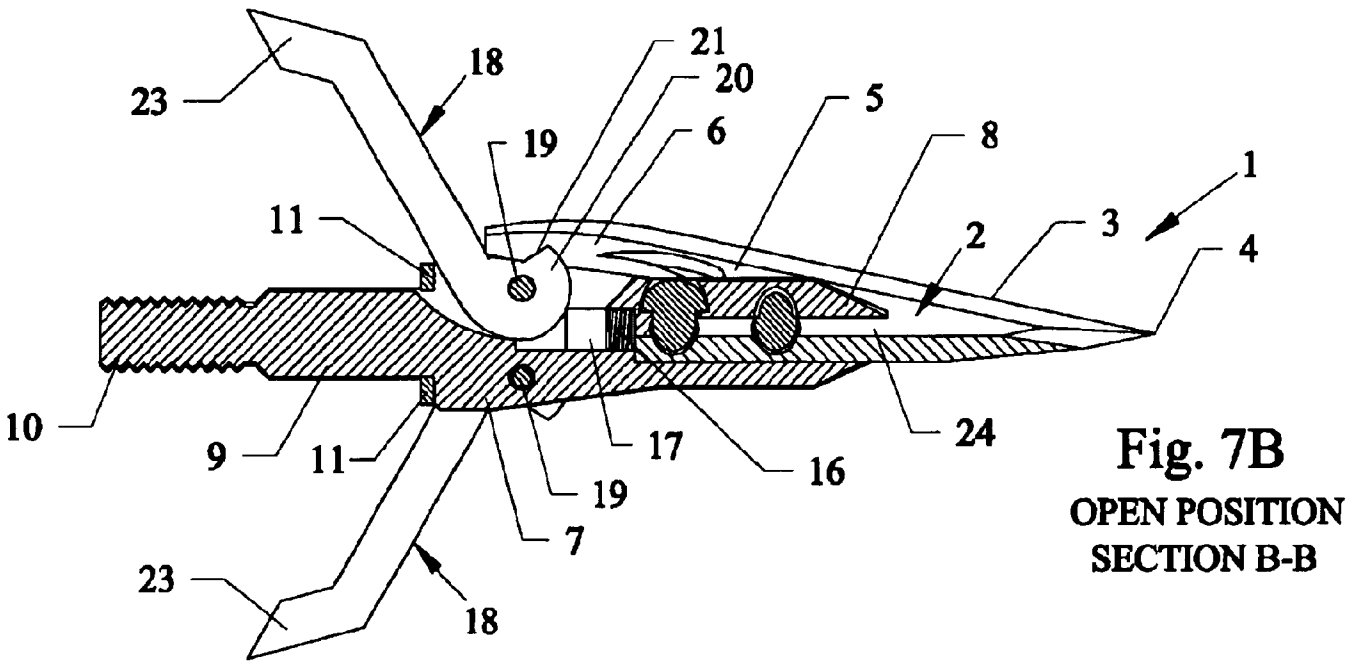
FIG. 7B shows a cutaway side view of the broadhead arrowhead in the open position.

During impact, flag-shaped fifth portions of deployable blades 18 are forced laterally outward by contact with the surface of the target. At the same time, as rapid deceleration of the broadhead is occurring, trigger 17 is urged forward away from ledges 21 thereby compressing tensioner 16. The combination of torque applied by fifth blade portions 23 contact with the target and relieved rearward pressure applied by trigger 17 permits deployable blades 18 to overcome the engagement between ledges 21 and trigger 17 and rotate about pivot screws 19 toward the rear as shown in FIG. 3 and FIG. 7.

The angle of deployment is limited by eventual contact between deployable blades 18 with ring 11. In the preferred embodiment, the maximum angle of deployment for blades 18 is preferably in the range of approximately 90 degrees and 170 degrees and more preferably in the range of approximately 100 degrees and 135 degrees as measured from the closed position. In the closed position, third blade portions 22 lie alongside body 7 and parallel to the longitudinal axis 15.

In the embodiment shown, ring 11 comprises a flat, annular device with an inner diameter equal to the outer diameter of second end 9 of body 7 and an outer diameter equal to the outer diameter of body 7. Ring 11 is placed over second end 9 prior to attaching second end 9 to an arrow shaft. Alternatively, ring 11 can be mechanically attached to body 7 by any means common in the art such as welding or adhesive bonding. Ring 11 may also be integrally formed along with body 7. Ring 11 may be made from any material such as steel, aluminum, plastic, etc., although metal is used in the preferred embodiment.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A broadhead arrowhead comprising:

a ferrule having a first end and a second end;

at least one main blade assembly coupled to and extending outwardly from said ferrule;

at least one deployable blade assembly, each coupled to said ferrule by a pivot shaft;

wherein said deployable blade assembly further comprises a semi-circular fourth blade portion integral to a first end of an elongated third blade portion, and a flag-shaped fifth blade portion integral to a second end of said third blade portion;

wherein said ferrule further comprises a deployable blade slot cut into the side of said ferrule for each said deployable blade assembly;

wherein said fourth blade portion fits into said deployable blade slot;

wherein said deployable blade slot is substantially coplanar with a longitudinal axis of said ferrule and is of a depth and geometry that permits each said deployable blade to rotate freely about said pivot shaft;

wherein said ferrule further comprises a cylindrical cavity that begins at the leading face of said first end of said ferrule and continues down a longitudinal axis of said ferrule to a depth approximately equal to the location of said at least one pivot shaft;

wherein said cavity contains a trigger, comprising a solid cylinder such that said trigger can slide freely within said cavity;

wherein said trigger includes a trailing surface that interfaces with a ledge on each said fourth blade portion when said deployable blades are in the closed position; and wherein said cavity further contains a mechanical tensioner located between the leading face of said trigger and the trailing edge of said main blade such that said trailing edge of said main blade compresses said tensioner, which in turn urges said trigger in the aft direction.

2. An arrowhead according to claim 1, wherein both said third blade portion and said fourth blade portion are disposed in a plane at least substantially parallel to a longitudinal axis of said ferrule and said fifth blade portion extends at an angle to the plane of said third blade portion; and said fifth blade portion is preferably continuously curved, wherein said deployable blade assembly has an airfoil-type shape.

3. An arrowhead according to claim 2, further comprising a plurality of said deployable blade assemblies disposed substantially symmetrically around the longitudinal axis of said ferrule.

4. An arrowhead according to claim 3, wherein said fifth blade portion has a leading edge region disposed at an angle to said ferrule.

5. An arrowhead according to claim 4, wherein said leading edge region is disposed at an angle to said ferrule in the range of about 5 degrees and about 45 degrees.

6. An arrowhead according to claim 5, wherein said leading edge region is disposed at an angle to said ferrule in the range of about 5 degrees and about 35 degrees.

7. An arrowhead according to claim 3, wherein said fifth blade portion has a length of between 20% and 50% of the overall length of said deployable blade assembly.

8. An arrowhead according to claim 3, wherein said continuously curved fifth blade portion has a radius of curvature of between about 0.2" and 0.5".

9. An arrowhead according to claim 3, further comprising at least two deployable blade assemblies disposed substantially symmetrically around the longitudinal axis of said ferrule at an angle of approximately 180 degrees from each other.

10. An arrowhead according to claim 3, further comprising means for mounting said arrowhead to an arrow shaft.

11. An arrowhead according to claim 3, further comprising means for limiting the deployment angle of said deployable blade assemblies.

12. An arrowhead according to claim 11, wherein said means limits the maximum deployment angle of said deployable blade assemblies in the range of about 90 degrees and 170 degrees.

13. An arrowhead according to claim 12, wherein said means limits the maximum deployment angle of said deployable blade assemblies in the range of about 100 degrees and 135 degrees.

14. A broadhead arrowhead comprising:

a ferrule having a first end and a second end;

a main blade assembly coupled to and extending outwardly from said ferrule in two directions diametrically opposite each other about a longitudinal axis of said ferrule;

at least one deployable blade assembly, each coupled to said ferrule by a pivot shaft;

wherein said main blade assembly has an air-foil type shape comprising:

a first substantially planar blade portion disposed in a plane at least substantially parallel to the longitudinal axis of said ferrule and two second portions, wherein said second portions are each disposed at an angle to the plane of said first planar portion and said second portions are also dispose at an angle to the longitudinal axis of said ferrule;

wherein said second portions are both generally continuously curved and are both angled relative to said first planar portion in the same rotational direction; and wherein said first portion of said blade assembly is coupled to said ferrule;

wherein said deployable blade assembly further comprises a semi-circular fourth blade portion integral to a first end of an elongated third blade portion, and a flag-shaped fifth blade portion integral to a second end of said third blade portion;

wherein said ferrule further comprises a deployable blade slot cut into the side of said ferrule for each said deployable blade assembly;

wherein said fourth blade portion fits into said deployable blade slot;

wherein said deployable blade slot is substantially coplanar with a longitudinal axis of said ferrule and is of a depth and geometry that permits each said deployable blade to rotate freely about said pivot shaft;

wherein said ferrule further comprises a cylindrical cavity that begins at the leading face of said first end of said ferrule and continues down a longitudinal axis of said ferrule to a depth approximately equal to the location of said at least one pivot shaft;

wherein said cavity contains a trigger, comprising a solid cylinder such that said trigger can slide freely within said cavity;

wherein said trigger includes a trailing surface that interfaces with a ledge on each said fourth blade portion when said deployable blades are in the closed position; and wherein said cavity further contains a mechanical tensioner located between the leading face of said trigger and the trailing edge of said main blade such that said trailing edge of said main blade compresses said tensioner, which in turn urges said trigger in the aft direction.

15. An arrowhead according to claim 14, wherein both said third blade portion and said fourth blade portion are disposed in a plane at least substantially parallel to a longitudinal axis of said ferrule and said fifth blade portion extends at an angle to the plane of said third blade portion; and said fifth blade portion is preferably continuously curved, wherein said deployable blade assembly has an airfoil-type shape.

16. An arrowhead according to claim 15, further comprising a plurality of said deployable blade assemblies disposed substantially symmetrically around the longitudinal axis of said ferrule.

17. An arrowhead according to claim 16, wherein said fifth blade portion has a leading edge region disposed at an angle to said ferrule.

18. An arrowhead according to claim 17, wherein said leading edge region is disposed at an angle to said ferrule in the range of about 5 degrees and about 45 degrees.

19. An arrowhead according to claim 18, wherein said leading edge region is disposed at an angle to said ferrule in the range of about 5 degrees and about 35 degrees.

20. An arrowhead according to claim 16, wherein said fifth blade portion has a length of between 20% and 50% of the overall length of said deployable blade assembly.

21. An arrowhead according to claim 16, wherein said continuously curved fifth blade portion has a radius of curvature of between about 0.2" and 0.5".

22. An arrowhead according to claim 16, further comprising at least two deployable blade assemblies disposed substantially symmetrically around the longitudinal axis of said ferrule at an angle of approximately 180 degrees from each other.

23. An arrowhead according to claim 16, further comprising means for mounting said arrowhead to an arrow shaft.

24. An arrowhead according to claim 16, further comprising means for limiting the deployment angle of said deployable blade assemblies.

25. An arrowhead according to claim 24, wherein said means limits the maximum deployment angle of said deployable blade assemblies in the range of about 90 degrees and 170 degrees.

26. An arrowhead according to claim 25, wherein said means limits the maximum deployment angle of said deployable blade assemblies in the range of about 100 degrees and 135 degrees.

27. An arrowhead according to claim 16, wherein said second portion has a length of between about 20% and 50% of the overall length of said main blade assembly.

* * * * *